US012703540B2

(12) United States Patent
Pedmo et al.

(10) Patent No.: US 12,703,540 B2
(45) Date of Patent: Aug. 11, 2026

(54) METAL LUG CLOSURE WITH PLUG

(71) Applicant: Plastipak Packaging, Inc., Plymouth, MI (US)

(72) Inventors: Marc A. Pedmo, Litchfield, OH (US); Andrew Fischer, Medina, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 17/702,205

(22) Filed: Mar. 23, 2022

(65) Prior Publication Data

US 2022/0306348 A1 Sep. 29, 2022

Related U.S. Application Data

(60) Provisional application No. 63/165,288, filed on Mar. 24, 2021.

(51) Int. Cl.
*B65D 41/04* (2006.01)

(52) U.S. Cl.
CPC ..... *B65D 41/0414* (2013.01); *B65D 41/0442* (2013.01)

(58) Field of Classification Search
CPC ..... B65D 41/0414; B65D 41/0442
USPC ..... 215/333, 345
See application file for complete search history.

(56) References Cited

U.S. PATENT DOCUMENTS 1,849,522 A 3/1932 Hammer
1,849,523 A 3/1932 Hammer
1,988,383 A 1/1935 Hermani
2,013,669 A 9/1935 Peters
3,096,898 A * 7/1963 Hohl ..... B65D 41/0442 215/345
3,155,261 A * 11/1964 Acton ..... B21D 51/44 235/91 PR
3,160,302 A * 12/1964 Chaplin ..... B65D 79/0087 220/624
3,253,727 A * 5/1966 Hart ..... B65D 41/0442 215/333
3,411,651 A * 11/1968 Mumford ..... B65D 41/0457 215/348
3,774,795 A 11/1973 Leenaards
(Continued)

FOREIGN PATENT DOCUMENTS

EP 2762415 A1 * 8/2014 ..... B65D 1/0207
FR 2864519 A1 7/2005
(Continued)

OTHER PUBLICATIONS

ISAIUSPTO; International Search Report and Written Opinion issued in corresponding international application No. PCT/US2015/037912; Date of Mailing: Sep. 24, 2015.
(Continued)

*Primary Examiner* — James N Smalley
(74) *Attorney, Agent, or Firm* — Reising Ethington P.C.

(57) ABSTRACT

A closure is configured to mate with the neck finish of a container. In embodiments, the closure includes an outer wall portion; an upper surface portion; a plug portion including an inner diameter portion; and a plurality of lugs configured to engage a neck finish of the container. In embodiments, a portion of the plug portion engages an inner diameter portion of an upper portion of the neck finish of the container.

21 Claims, 7 Drawing Sheets

(56) References Cited

U.S. PATENT DOCUMENTS 3,788,508 A * 1/1974 Vercillo ..... B65D 41/0442 215/349
3,913,772 A * 10/1975 Ochs ..... B65D 41/3404 215/256
4,006,837 A 2/1977 Gates et al.
4,392,580 A * 7/1983 Ochs ..... B65D 41/0442 215/332
4,533,059 A * 8/1985 Kapolas ..... B65D 41/04 215/276
4,662,530 A 5/1987 Goncalves et al.
5,678,711 A 10/1997 Tobias
5,944,207 A 8/1999 Reidenbach
5,967,352 A 10/1999 Repp et al.
6,062,408 A 5/2000 Beck et al.
D428,815 S 8/2000 Mooney et al.
6,124,008 A 9/2000 Barre
D442,886 S 5/2001 Carrell, Jr.
6,228,317 B1 5/2001 Smith et al.
6,495,226 B1 12/2002 Slat
6,568,156 B2 5/2003 Silvers et al.
6,648,157 B2 11/2003 Shai et al.
6,740,284 B2 5/2004 Darr et al.
6,763,968 B1 7/2004 Boyd et al.
6,814,923 B2 11/2004 Bromley
6,857,531 B2 2/2005 Slat et al.
6,933,055 B2 8/2005 Share et al.
6,997,336 B2 2/2006 Yourist et al.
7,083,059 B1 8/2006 Le Guen
7,182,213 B2 2/2007 King
7,207,451 B2 4/2007 Taylor et al.
7,226,560 B2 6/2007 Dunlap
7,691,290 B2 4/2010 Deshpande et al.
7,732,035 B2 6/2010 Pedmo et al.
7,770,745 B2 8/2010 Weissmann et al.
7,861,874 B2 1/2011 Cook et al.
7,866,496 B2 1/2011 Kraft
8,292,102 B2 10/2012 Penny et al.
8,596,029 B2 12/2013 Pedmo et al.
8,672,159 B2 3/2014 Moreira
8,870,006 B2 10/2014 Kamineni et al.
9,150,320 B2 10/2015 Wurster et al.
9,205,958 B2 12/2015 Cook
10,676,250 B2 * 6/2020 Sims ..... B65D 1/0246
10,759,559 B2 9/2020 Kraft
11,136,167 B2 10/2021 Kraft
2002/0020149 A1 2/2002 Silvers et al.
2003/0124374 A1 7/2003 Bromley et al.
2004/0000127 A1 1/2004 Joshi et al.
2005/0163882 A1 7/2005 Dunlap et al.
2006/0011633 A1 1/2006 Cook et al.
2007/0012650 A1 1/2007 Eble
2007/0045216 A1 3/2007 Gami et al.
2007/0289933 A1 12/2007 Weissmann et al.
2009/0008360 A1 1/2009 Piccioli et al.
2010/0096356 A1 * 4/2010 Forrest ..... B65D 1/165 215/331
2011/0024382 A1 2/2011 Moreira
2011/0100988 A1 5/2011 Fraser et al.
2011/0171405 A1 7/2011 Deshpande
2011/0172335 A1 7/2011 Deshpande
2011/0220668 A1 9/2011 Steih et al.
2012/0000879 A1 1/2012 McFarlane et al.
2012/0061410 A1 3/2012 Kamineni et al.
2012/0255927 A1 10/2012 Cook
2013/0206718 A1 8/2013 Toribio et al.
2014/0263155 A1 * 9/2014 Szczesniak ..... B65D 79/0087 215/252
2015/0274378 A1 10/2015 Galownia et al.

FOREIGN PATENT DOCUMENTS

GB 2589711 A * 6/2021 ..... B65D 1/10
KR 2009114010 A * 11/2009

OTHER PUBLICATIONS

English Summary of first Chinese Office Action 201580043810.8, dated Nov. 29, 2017.

* cited by examiner

METAL LUG CLOSURE WITH PLUG

CROSS-REFERENCE TO RELATED APPLICATION

This application claims the benefit of U.S. Provisional Application No. 63/165,288, filed Mar. 24, 2021, which is incorporated herein by reference in its entirety.

TECHNICAL FIELD

The present disclosure relates to closures for bottles and containers, and assemblies thereof, including those with a metal lug closure that includes an inner diameter plug.

BACKGROUND

Closures are used in connection with a variety of bottles and containers, including plastic (or polymeric) bottles and containers having a neck finish. Plastic neck finishes may include threading that is injection molded or blow molded. Moreover, plastic neck finishes may be used in a variety of container applications, including "wide-mouth" and/or hot-fill container applications, as well as other applications that may require a neck finish to sufficiently retain its shape over an extended period of time and to maintain structural and seal integrity with respect to a closure.

Various products, including food products, may be stored in plastic containers, and a metal or polymeric closure may be used in connection with such containers. Such closures may include a plurality of threading features and/or lugs that are configured to couple the closure to a polymeric finish of a container.

However, challenges can exist with respect to the use of closures, such as in connection with blow trim containers that are filled or processed via pasteurization or hot fill. For example, with such closures, "squaring" or "faceting" can sometimes occurs, such as in connection with a blow trim neck finish. In some cases, shrinkage may occur, and the finish may no longer remain sufficiently round. The severity may depend, among other things, on the associated process and the thermal properties of the neck portion.

Among other things, it can be desirable to provide closures that address one or more challenges associated with various bottles or containers, including those that are filled or processed in connection with pasteurization or hot fill processes.

SUMMARY

A closure is configured to mate with the neck finish of a container. In embodiments, the closure includes an outer wall portion; an upper surface portion; a plug portion including an inner diameter portion; and a plurality of lugs configured to engage a neck finish of the container. In embodiments, a portion of the plug portion engages an inner diameter portion of an upper portion of the neck finish of the container.

BRIEF DESCRIPTION OF THE DRAWINGS

Embodiments of the disclosure will now be described, by way of example, with reference to the accompanying drawings, wherein.

DETAILED DESCRIPTION

Reference will now be made in detail to embodiments of the present disclosure, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined herein and by appended claims.

Figure 1:
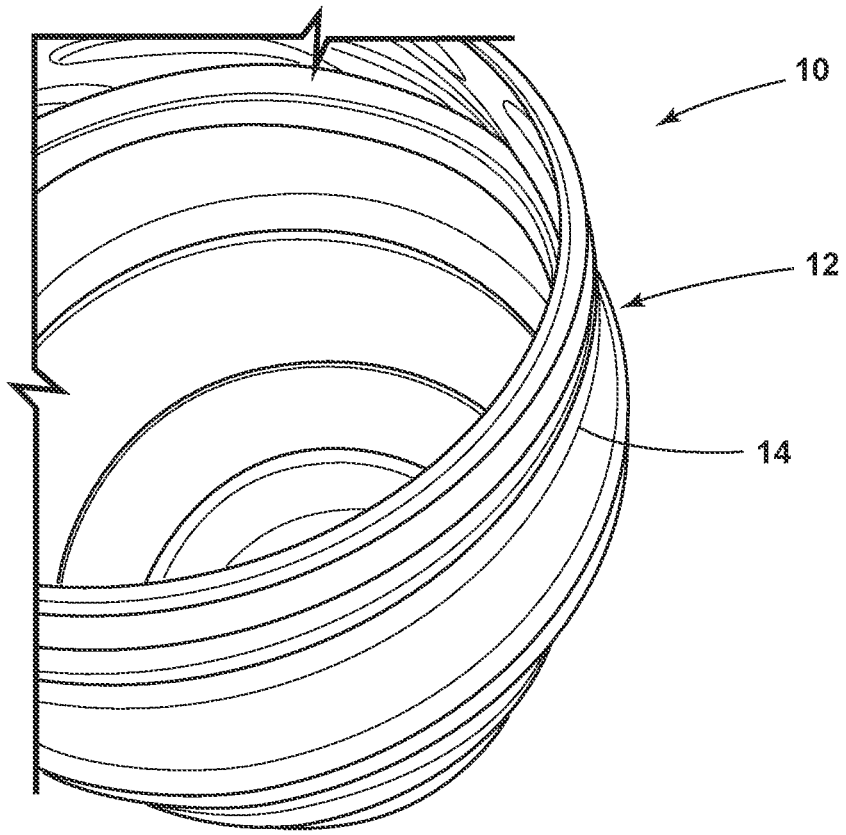
FIG. 1 is a perspective view of a portion of a container.

FIG. 1 generally illustrates an embodiment of a plastic container 10 in accordance with aspects or teachings of the present disclosure. The plastic container 10 may comprise a plastic neck finish 12 that may include one or more threads 14. Embodiments of the container may be formed from various polymers known in the field—for example and without limitation, polyethylene terephthalate (PET). Embodiments of the container 10, and the included neck finish 12, may be formed via injection molding, blow molding, compression molding, or other known molding techniques. An embodiment of a wide-mouth plastic container is generally illustrated in U.S. Pat. No. 10,759,559, the contents of which is incorporated herein by reference in its entirety.

Figure 2:
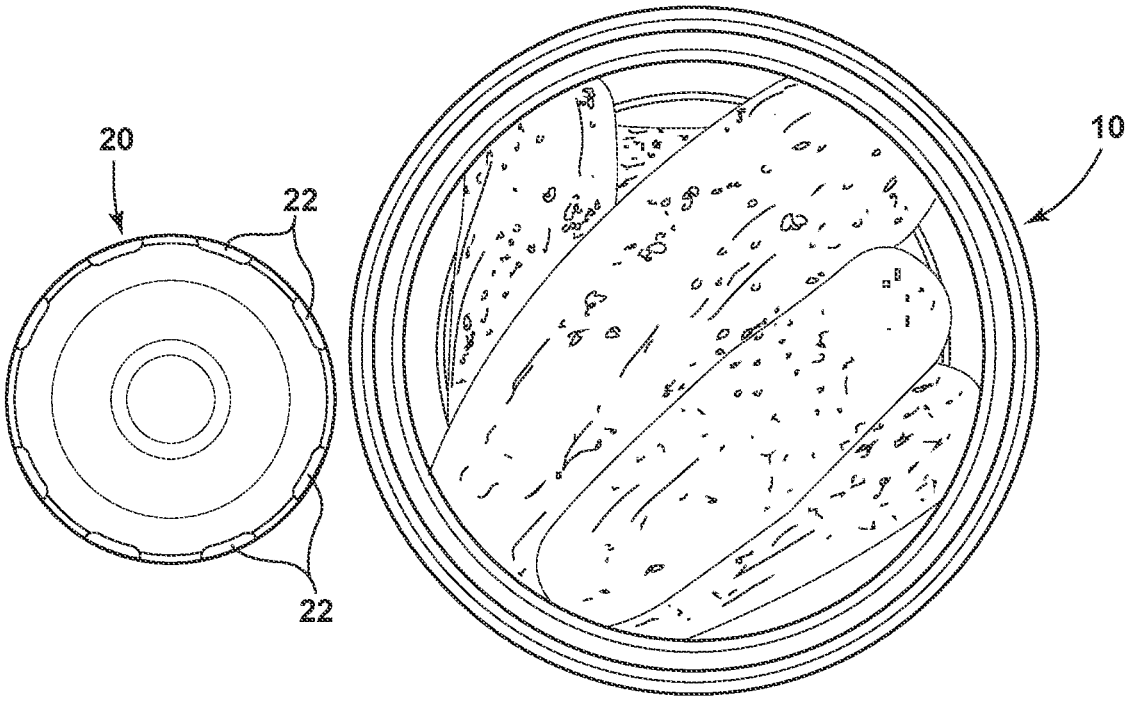
FIG. 2 is top view of a portion of a container holding contents and a separate closure.

As generally illustrated in FIG. 2, the plastic container 10 may be used to hold various contents, including, for example and without limitation, food contents or various other items or commodities. A closure 20, which may include a plurality of lugs 22 that may be configured to mate with the finish 12 of a plastic container 10. The closure 20 may be used to seal the contents of the container 10. In embodiments, a closure 20 may be comprised of various suitable materials including, without limitation, metallic materials such as steel, tin, or aluminum.

Figure 3:
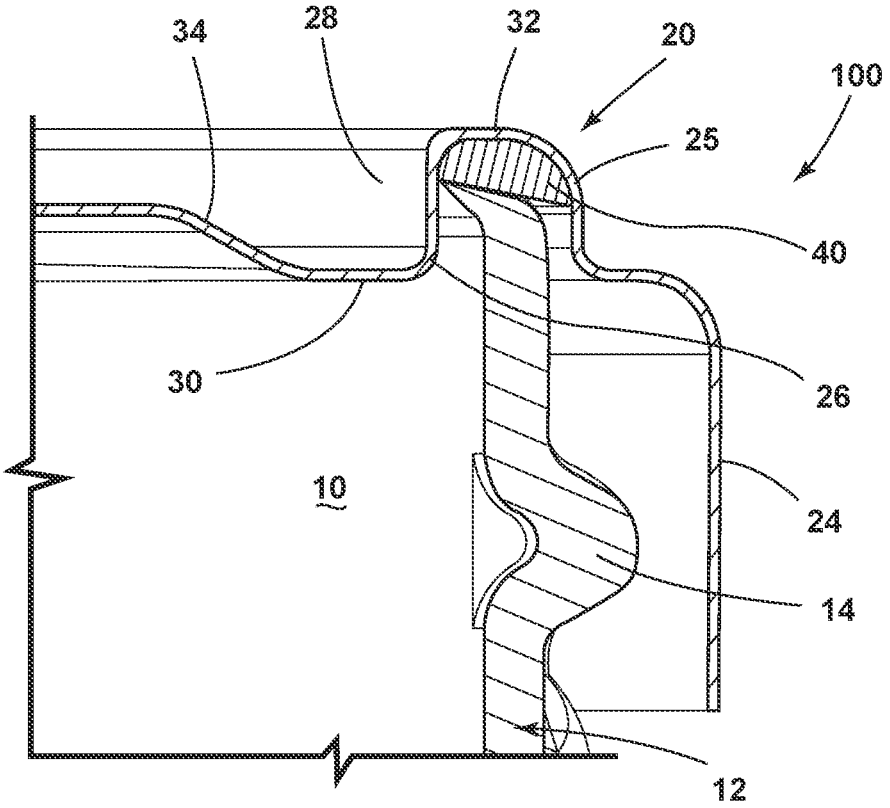
FIG. 3 is a partial cross-sectional view of an embodiment of a container and closure assembly according to aspects or teachings of the present disclosure.

An embodiment of a container and closure assembly 100 comprising a closure 20 engaged with a neck finish 12 of a plastic container 10 in accordance with aspects or teachings of the present disclosure is generally illustrated in FIG. 3. As generally illustrated, the closure 20 may include an outer wall portion 24 including an upper radially-inward portion 25; a plug portion 26 including an inner diameter portion 28, a lower inner portion 30, and an upper surface portion 32; and an upward portion 34. In embodiments, an inner diameter portion 28 may be vertical or substantially vertical—i.e., may be substantially parallel to a central vertical axis of a container. As generally illustrated, with embodiments, the upper radially-inward portion 25, the upper surface portion 32, and the inner diameter portion may extend down inside the inner diameter of the finish to cooperate to form a "plug" that envelopes/engages (e.g., generally is form fit about) an upper portion of a neck finish 12. The neck finish 12 may, for example and without limitation (and as generally depicted in FIG. 3), comprise a blown and trimmed finish. The inner diameter portion 28 may, among other things, provide additional support to an adjacent portion of an upper portion of the neck finish 12. Embodiments of the closure, for example as illustrated, may include a sealing gasket 40.

Figure 4:
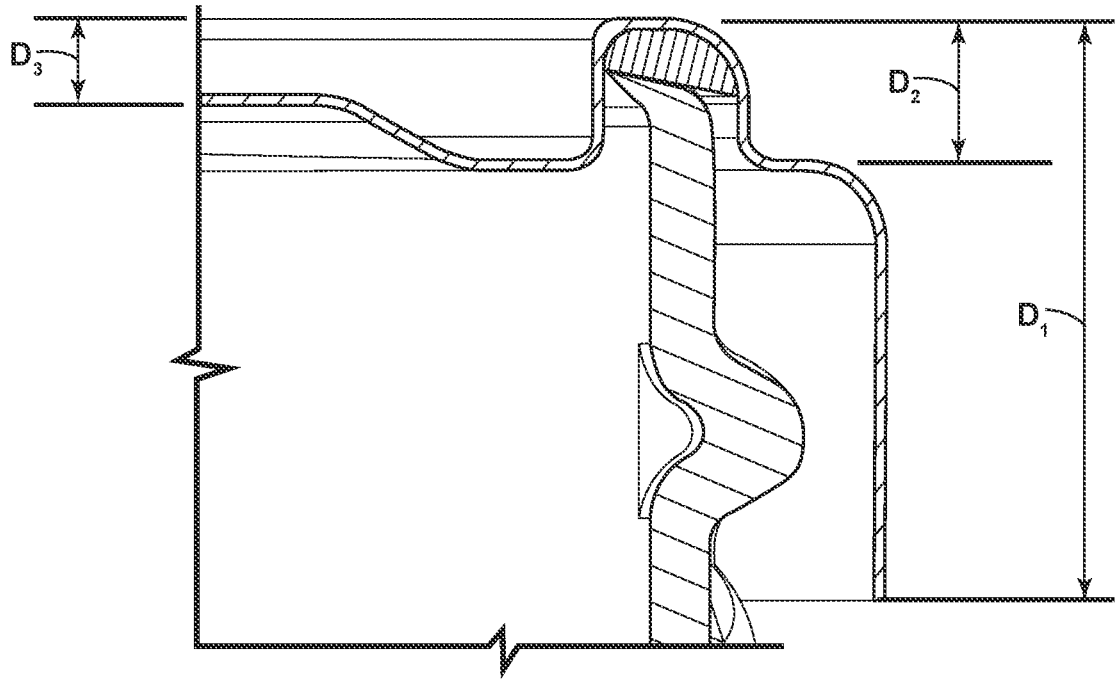
FIG. 4 is an enlarged view of a portion of the embodiment of the container and closure assembly illustrated in FIG. 3.

As generally illustrated in FIG. 4, with an embodiment of a container and closure assembly 100, the closure 20 may have an overall vertical height/distance D1. For many applications, D1 will be less than 1.00 inches (25.4 mm). In an embodiment, for example and without limitation, a distance D2 may generally corresponds to (i) a vertical distance from a top/upper surface (e.g., upper surface portion 32) of the closure to the bottom of an upper radially-inward portion 25 of an outer wall portion 24 and/or (ii) a vertical distance from a top/upper surface (e.g., upper surface portion 32) of the closure to the bottom of the inner diameter portion 28. However, while the aforementioned distances associated with (i) and (ii) may be substantially the same, with embodiments either distance may be greater than the other. Further, with embodiments, D2 may be at least or about 0.15 times D1; D2 may be at least or about 0.20 times D1; D2 may be at least or about 0.2467 times D1; or D2 may be greater than 0.25 times D1.

In an embodiment, for example and without limitation, a distance D3 may generally correspond to a more radially inward portion of the closure at about the portion where a vertical distance from a top/upper surface (e.g., upper surface portion 32) of the closure to a more radially inward/central portion of a closure at or about the point/portion where the upward portion 34 reaches its highest vertical position. In some embodiments, D3 may be flush with upper surface portion 32. Further, with some embodiments, D3 may be at least or about 0.12 times D1, or may be at least or about 0.15 times D1; and/or D3 may be at least or about 0.61 times D2, or D3 may be less than about 0.60 times D2.

Figure 5:
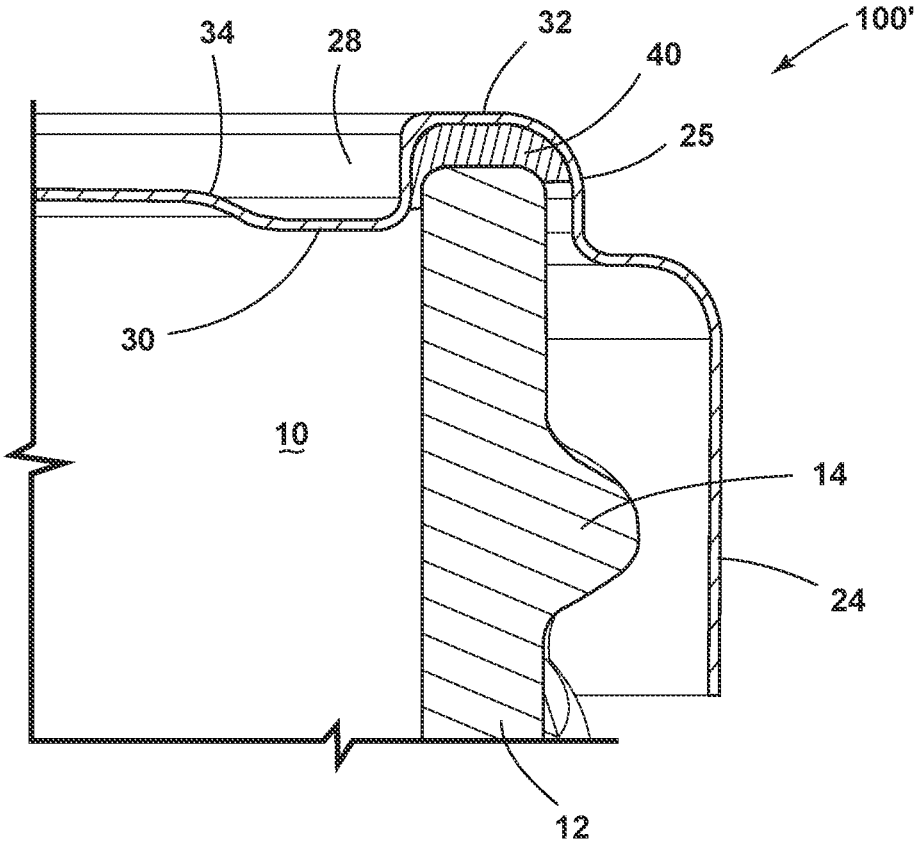
FIG. 5 is an enlarged view of a portion of the embodiment of the container and closure assembly according to aspects or teachings of the present disclosure.

FIG. 5 generally illustrates another embodiment of a container and closure assembly 100' in accordance with aspects and teachings of the present disclosure. The illustrated closure assembly 100' shown in FIG. 5 has a number of similar features to those depicted in connection with the embodiment of an assembly shown in connection with FIGS. 3 and 4. However, for example and without limitation, the neck finish 12 such as generally illustrated in FIG. 5 may comprise an injected, e.g., injection molded, finish.

Figure 6:
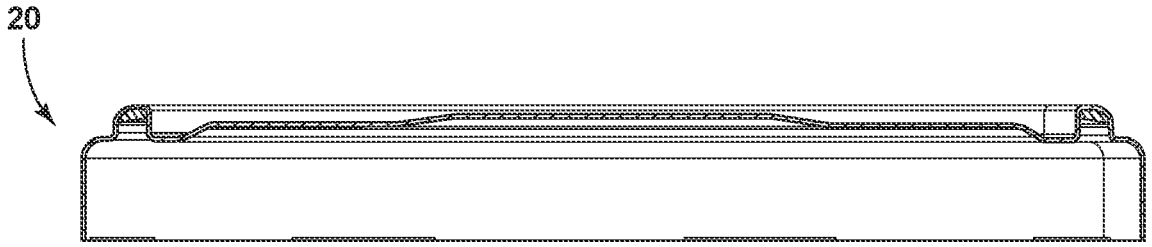
FIG. 6 is an internal side partial sectional view of an embodiment of a closure according to aspects or teachings of the present disclosure.
Figure 7:
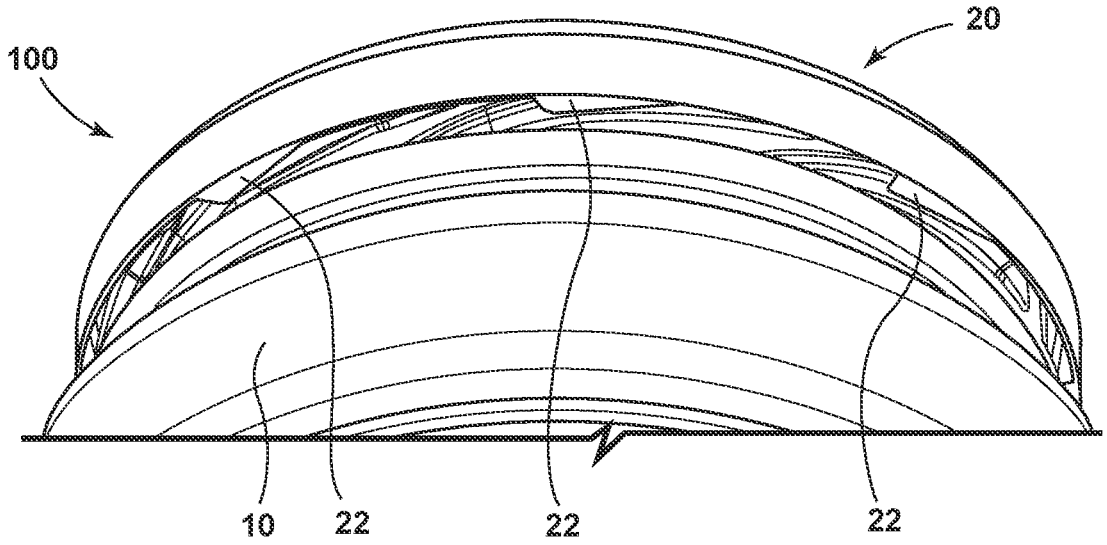
FIG. 7 is a side perspective view of an embodiment of a container and closure assembly according to aspects or teachings of the present disclosure.
Figure 8:
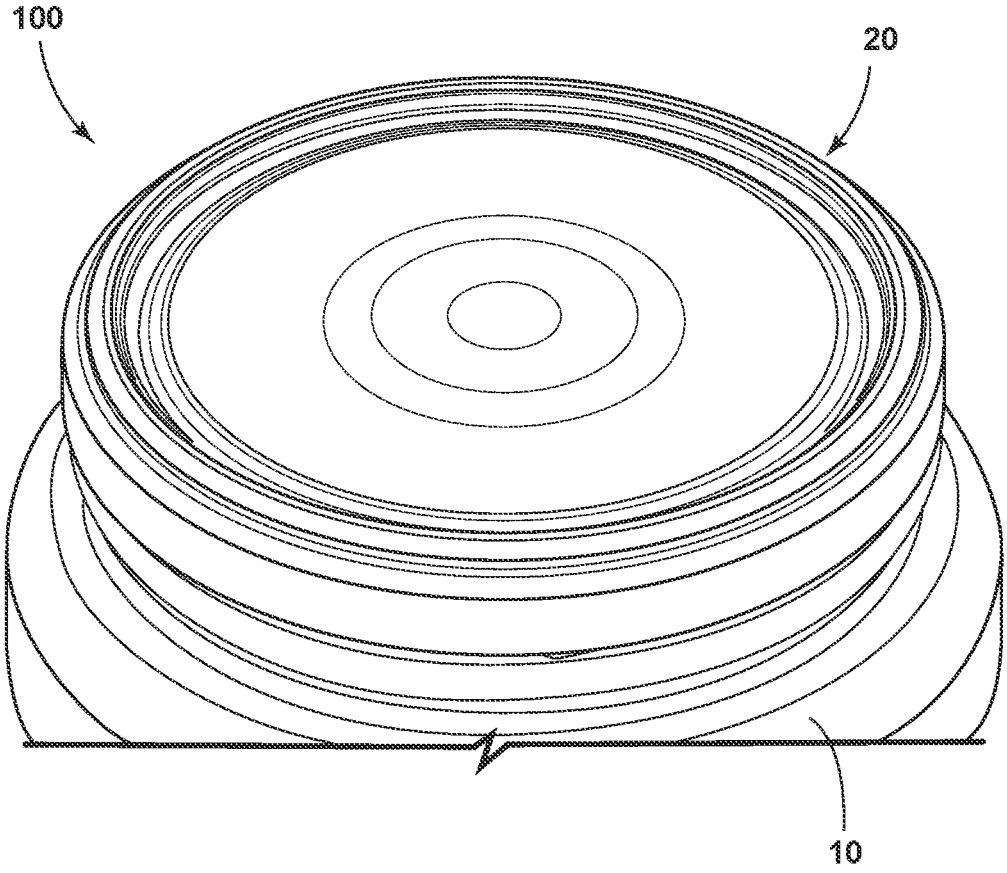
FIG. 8 is a partial perspective view of an embodiment of a container and closure assembly according to aspects or teachings of the present disclosure.

An internal side partial sectional view of an embodiment of a closure 20 is generally illustrated in FIG. 6. A side perspective view of an embodiment of a container and closure assembly 100, including a container 10 and a closure 20 with a plurality of lugs 22, is generally illustrated in FIG. 7. FIG. 8 generally illustrates an embodiment of a container and closure assembly 100 in an engaged condition.

Various embodiments are described herein for various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "with embodiments," "in embodiments," or "an embodiment," or the like, means that a particular feature, structure, or characteristic described in connection with the embodiment is included in at least one embodiment. Thus, appearances of the phrases "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." in the specification is to be construed broadly and is used to provide non-limiting examples of embodiments of the disclosure, and the disclosure is not limited to such examples. Uses of "and" and "or" are to be construed broadly (e.g., to be treated as "and/or"). For example and without limitation, uses of "and" do not necessarily require all elements or features listed, and uses of "or" are intended to be inclusive unless such a construction would be illogical.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

It is intended that all matter contained in the above description or shown in the accompanying drawings shall be interpreted as illustrative only and not limiting. Changes in detail or structure may be made without departing from the present disclosure.

What is claimed is:

1. A closure configured to mate with a neck finish of a container, the closure comprising:

an outer wall portion having an upper radially-inward portion with a vertical segment, the outer wall portion including a segment below the upper radially-inward portion that extends substantially horizontally in a radially outward direction;

an upper surface portion;

a plug portion including an inner diameter portion; the inner diameter portion, the upper surface portion, and the upper radially-inward portion together form an inverted substantially U-shaped receiving formation configured to receive a portion of said neck finish; and a plurality of lugs configured to engage said neck finish of said container;

wherein a portion of the plug portion engages an inner diameter segment of an upper portion of said neck finish; the inner diameter portion extends downwardly from the upper surface portion below a portion of the upper portion of said neck finish; and a vertical length of the inner diameter portion is substantially the same as a horizontal length of a lower inner portion.

2. The closure of claim 1, wherein the closure is comprised of metal.

3. The closure of claim 1, wherein the closure is comprised of one or more of steel, tin, and aluminum.

4. A closure configured to mate with a neck finish of a container, the closure comprising:

an outer wall portion having an upper radially-inward portion with a vertical segment, the outer wall portion including a segment below the upper radially-inward portion that extends substantially horizontally in a radially outward direction;

an upper surface portion;

a sealing gasket disposed adjacent at least a portion of an upper surface portion, disposed entirely vertically above a lower inner portion of the closure, and disposed entirely vertically above a lowermost portion of the upper radially-inward portion;

a plug portion including an inner diameter portion; and a plurality of lugs configured to engage said neck finish of said container;

wherein a portion of the plug portion engages an inner diameter segment of an upper portion of said neck finish, the inner diameter portion extends downwardly from the upper surface portion around the sealing gasket and below a radially inward portion of the upper portion of said neck finish, and the segment below the upper radially-inward portion that extends substantially horizontally in a radially outward direction and the inner diameter portion are substantially vertically aligned.

5. The closure of claim 1, wherein the closure has an overall vertical height/distance.

6. The closure of claim 5, wherein the overall vertical height/distance is less than 1.00 inches (25.4 mm).

7. The closure of claim 5, wherein the closure includes a distance D2 that corresponds to a vertical distance from a top/upper surface of the closure to a bottom of the inner diameter portion; and wherein the distance D2 is about 0.15 times the overall vertical height/distance.

8. The closure of claim 5, wherein the closure includes a distance D2 that corresponds to a vertical distance from a top/upper surface of the closure to a bottom of the inner diameter portion; and wherein the distance D2 is at least 0.15 times the overall vertical height/distance.

9. The closure of claim 5, wherein the closure includes a distance D2 that corresponds to a vertical distance from a top/upper surface of the closure to a bottom of the inner diameter portion; and wherein the distance D2 is about 0.20 times the overall vertical height/distance.

10. The closure of claim 5, wherein the closure includes a distance D2 that corresponds to a vertical distance from a top/upper surface of the closure to a bottom of the inner diameter portion; and wherein the distance D2 is at least 0.20 times the overall vertical height/distance.

11. The closure of claim 5, wherein the closure includes a distance D2 that corresponds to a vertical distance from a top/upper surface of the closure to a bottom of the inner diameter portion; and wherein the distance D2 is about 0.2467 times the overall vertical height/distance.

12. The closure of claim 5, wherein the closure includes a distance D2 that corresponds to a vertical distance from a top/upper surface of the closure to a bottom of the inner diameter portion; and wherein the distance D2 is at least 0.2467 times the overall vertical height/distance.

13. The closure of claim 5, wherein the closure includes a distance D2 that corresponds to a vertical distance from a top/upper surface of the closure to a bottom of the inner diameter portion; and wherein the distance D2 is greater than about 0.25 times the overall vertical height/distance.

14. The closure of claim 5, wherein the closure includes a distance D3 that corresponds to a more radially inward portion of the closure at about the portion where a vertical distance from a top/upper surface of the closure to a more radially inward/central portion of the closure at or about a point/portion where an upward portion reaches its highest vertical position; and wherein the distance D3 is about 0.12 times the overall vertical height/distance.

15. The closure of claim 5, wherein the closure includes a distance D3 that corresponds to a more radially inward portion of the closure at about the portion where a vertical distance from a top/upper surface of the closure to a more radially inward/central portion of a closure at or about a point/portion where an upward portion reaches its highest vertical position; and wherein the distance D3 is at least 0.12 times the overall vertical height/distance.

16. The closure of claim 5, wherein the closure includes a distance D3 that corresponds to a more radially inward portion of the closure at about the portion where a vertical distance from a top/upper surface of the closure to a more radially inward/central portion of a closure at or about a point/portion where an upward portion reaches its highest vertical position; and wherein the distance D3 is about 0.15 times the overall vertical height/distance.

17. The closure of claim 5, wherein the closure includes a distance D3 that corresponds to a more radially inward portion of the closure at about the portion where a vertical distance from a top/upper surface of the closure to a more radially inward/central portion of a closure at or about a point/portion where an upward portion reaches its highest vertical position; and wherein the distance D3 is at least 0.15 times the overall vertical height/distance.

18. The closure of claim 1, wherein an upward portion extends at an angle upwardly from the lower inner portion.

19. The closure of claim 1, wherein the upper radially-inward portion has a vertical distance that is substantially equal to a vertical distance of the inner diameter portion.

20. A container and closure assembly comprising a closure as recited in claim 1 and a container.

21. A closure configured to mate with a neck finish of a container, the closure comprising:

an outer wall portion having an upper radially-inward portion with a vertical segment, the outer wall portion including a segment below the upper radially-inward portion that extends substantially horizontally in a radially outward direction;

an upper surface portion;

a plug portion including an inner diameter portion; such that the inner diameter portion, the upper surface portion, and the upper radially-inward portion together form an inverted substantially U-shaped receiving formation configured to receive a portion of said neck finish;

a sealing gasket disposed adjacent at least a portion of an upper surface portion and disposed entirely within the inverted substantially U-shaped receiving formation; and wherein a portion of the plug portion engages an inner diameter segment of an upper portion of said neck finish; the inner diameter portion extends downwardly from the upper surface portion below a portion of the upper portion of said neck finish; and a vertical length of the inner diameter portion is substantially the same as a horizontal length of a lower inner portion.

* * * * *